US007350531B2

(12) United States Patent
Coe

(10) Patent No.: US 7,350,531 B2
(45) Date of Patent: Apr. 1, 2008

(54) ADJUSTABLE CRUTCH

(76) Inventor: Thomas Edward Coe, 26 Lynn Grove Rd., Northwood, NH (US) 03261

( * ) Notice: Subject to any disclaimer, the term of this patent is extended or adjusted under 35 U.S.C. 154(b) by 0 days.

(21) Appl. No.: 11/175,733

(22) Filed: Jul. 6, 2005

(65) Prior Publication Data

US 2007/0006906 A1 Jan. 11, 2007

(51) Int. Cl.
*A61H 3/02* (2006.01)

(52) U.S. Cl. ..... 135/69

(58) Field of Classification Search ..... 135/65, 135/68, 69, 75; 267/64.11, 64.12, 64.16; 188/313, 316, 317, 300; 297/344.16, 344.18
See application file for complete search history.

(56) References Cited

U.S. PATENT DOCUMENTS 3,157,188 A * 11/1964 Farnham ..... 135/69
3,416,546 A * 12/1968 Carpenter ..... 135/68
4,252,137 A 2/1981 Cohen
4,750,507 A 6/1988 Kazda
5,036,873 A 8/1991 Clayton
5,219,152 A * 6/1993 Derrien et al. ..... 267/64.15
5,348,112 A * 9/1994 Vaillancourt ..... 180/227
5,769,104 A 6/1998 Uemura
5,924,434 A 7/1999 Cato, III
6,044,940 A * 4/2000 Marzocchi et al. ..... 188/299.1
2003/0116897 A1* 6/2003 Knapp ..... 267/64.12
2006/0011229 A1* 1/2006 Tseng ..... 135/70

* cited by examiner

*Primary Examiner*—David Dunn
*Assistant Examiner*—Noah Chandler Hawk
(74) *Attorney, Agent, or Firm*—Davis Bujold & Daniels, P.L.L.C.

(57) ABSTRACT

A adjustable crutch, cane or similar walking aid for assisting everyday movement for temporarily injured and even permanently handicapped persons, the crutch having telescoping crutch tubes encasing a locking gas spring crutches which can instantaneously and controllably be adjusted in length during use, thereby considerably facilitating such common physical activities as sitting down, standing up, negotiating stairs or other obstacles and other similar everyday mobile activities. The locking gas spring functions by internal gas pressure and the telescoping crutch tubes are extended as the internal gas pressure seeks to reach the lowest energy state by maximizing its internal volume. For safety purposes a disengagement mechanism is provided so that extension occurs up to a preset level dictated by the user, and can even be overridden if desired.

14 Claims, 10 Drawing Sheets

11
65
61
19
67
63
19
A
23

ADJUSTABLE CRUTCH

FIELD OF TECHNOLOGY

The present invention relates to crutches, canes or similar walking aids for assisting everyday movement for temporarily injured and even permanently handicapped persons. More particularly, the invention relates to crutches which can instantaneously and controllably be adjusted in length during their use, thereby, among other things, considerably facilitating such common physical activities as sitting down, standing up, negotiating stairs or other obstacles and other similar everyday mobile activities.

BACKGROUND OF TECHNOLOGY

The adjustable crutches presently available in the market basically consist of two telescoping tubes, usually made of a metal or metal alloy, which can be secured relative to one another by means of a variety of mechanical locking mechanisms arranged at regular intervals along the tube parts. A common design of the locking devices is that both of the tube parts are provided with diametrically opposed holes which can be placed in alignment with each other, the locking taking place by inserting a pin, detend or the like through the holes in the two tubes and securing the tubes in a desired position. The purpose of the crutch adjustability in this case makes it possible for two persons of different heights to use the same crutch. A suitable crutch length can be attained for a person depending on that person's height. Once this length has been determined it is maintained until a different person uses the crutch and the length is readjusted accordingly.

These types of crutches have several disadvantages which, among other things, are related to the fact that the person is unable to change the length of the crutch during use. For example, because of the fixed crutch length, the person has very little help when sitting down, standing up, using stairs, and other similar everyday mobile activities. During these routine activities the person must rely on arm rests, chair seats, etc. for support. This can be especially difficult for older or more incapacitated persons.

OBJECT AND SUMMARY OF THE INVENTION

There is a need for a crutch which facilitates sitting and standing in a controlled and assisted fashion while ensuring the safety of the user. The present invention is directed at further solutions to address this need.

In accordance with one aspect of the present invention a crutch is provided having an instantaneously and user controlled adjustable length feature which facilitates activities such as sitting and standing in a controlled and assisted fashion.

In accordance with another aspect of the present invention the controlled adjustable length feature of the crutch is controlled by the user according to a locking gas spring incorporated between a relatively moveable upper crutch tube and lower crutch tube.

In accordance with yet another aspect of the present invention the crutch has a handle which the user can grasp to utilize the crutch in the known manner and the handle also comprising an operative means for a controlling a pressure valve in the locking gas spring pressure.

In accordance with further aspects of the present invention the crutch is provided with a user defined maximum height setting which can be readily changed for different user's of different heights.

In accordance with still another aspect of the present invention the user defined maximum height setting includes an automated shut-off mechanism to limit the maximum length of the crutch.

An adjustable crutch for facilitating mobility comprising a telescoping shaft having an upper and lower crutch tube aligned on a concentric axis, a handle attached to an intermediate portion of the telescoping shaft, a shoulder support attached to the crutch on a first end of the upper crutch tube and a ground engaging butt end positioned at a first end of the lower crutch tube, a locking gas spring comprising a gas cylinder and a moveable piston is positioned inside the telescoping shaft for controlling relative slidable movement between the upper and lower crutch tubes of the telescoping shaft and wherein a control button is positioned on the handle for operating the gas spring, and an automatic disengagement mechanism is provided in the crutch for interrupting operation of the gas spring and limiting extension of the crutch.

A method of adjusting a crutch for facilitating mobility, the method comprising the steps of aligning a telescoping shaft having an upper and lower crutch tube on a concentric axis, attaching a handle to an intermediate portion of the telescoping shaft, attaching a shoulder support to the crutch on a first end of the upper crutch tube and positioning a ground engaging butt end at a first end of the lower crutch tube, providing a locking gas spring comprising a gas cylinder and a moveable piston inside the telescoping shaft for controlling relative slidable movement between the upper and lower crutch tubes of the telescoping shaft, and actuating a control button positioned on the handle for operating the gas spring, and interrupting operation of the gas spring and limiting extension of the crutch according to a preset extension limit effected by an automatic disengagement mechanism.

DETAILED DESCRIPTION OF THE PREFERRED EMBODIMENTS

Figure 1:
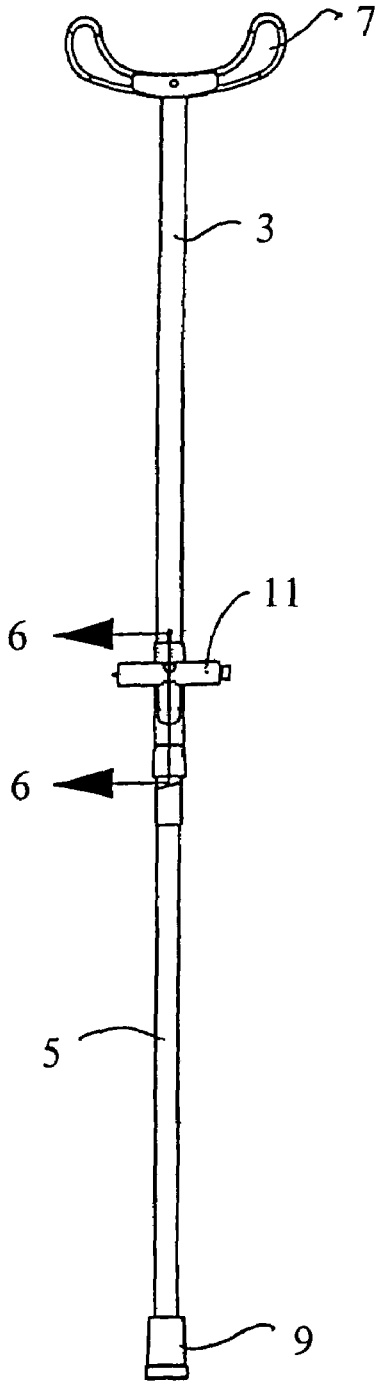
FIG. 1 is a side view of one embodiment of the crutch.
Figure 2:
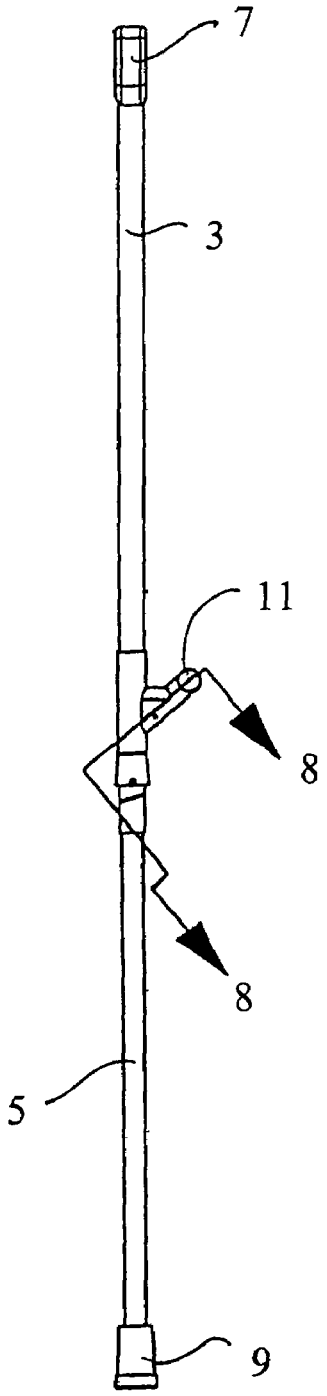
FIG. 2 is a front view of one embodiment of the crutch.
Figure 3:
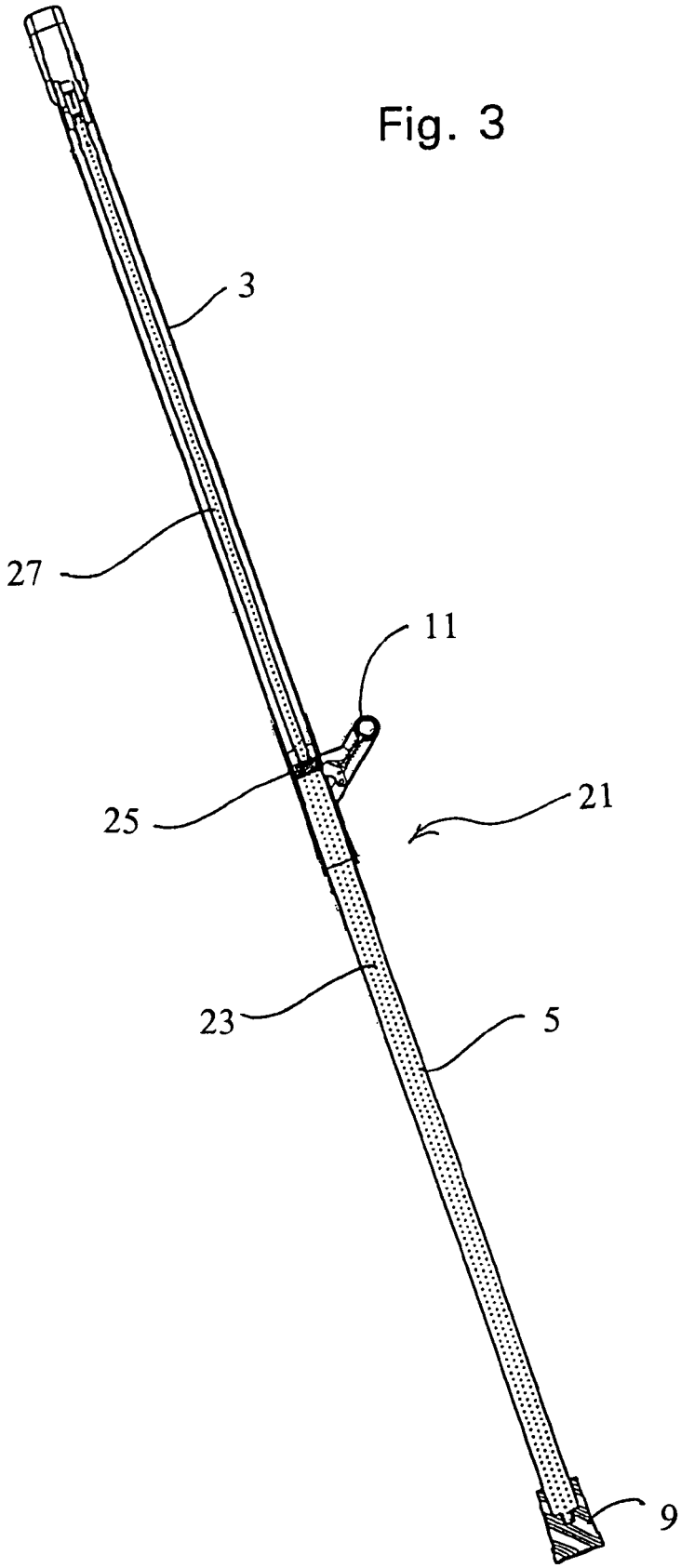
FIG. 3 is a cross-sectional front view of one embodiment of the crutch.

An adjustable crutch 1, as displayed in a first embodiment shown in FIGS. 1, 2 and 3 is designed around a locking gas spring, as described in detail below, to facilitate the immediate and safe adjustability, i.e. either the lengthening or shortening of the crutch 1, by the user at any given time. The crutch 1 includes in general an upper crutch tube 3 and a lower crutch tube 5, a shoulder support 7, a butt end 9 and a handle 11. The lower crutch tube 5 is shown at least partially inserted and telescoping within the upper crutch tube 3 so that upon adjusting the length of the crutch 1, as described in further detail below, the lower crutch tube 5 is either slidably withdrawn from the upper crutch tube 3 or slidably inserted deeper within the upper tube such that the respective tubes are slidably adjustable with respect to one another.

The slidable, telescoping relative movement of the upper and lower crutch tubes 3, 5 is controlled by the gas spring 21 housed within at least a portion of both the upper and the lower crutch tubes. As is commonly known in the art, the gas spring 21 generally includes a gas cylinder 23, a piston 25 and a piston rod 27. As is apparent from FIG. 3, the gas cylinder 23 is situated in the lower crutch tube 5 and the piston rod 27 portion of the gas spring 21 is affixed at one end to the upper crutch tube 3 with the opposing end of the piston rod 27 attached within the piston 25 and is generally freely slidable within the gas cylinder 23. This arrangement of the gas cylinder and piston in the crutch is important with regards to the functional aspects and other structural features of the crutch in that it provides a safe and easy to operate device as will be discussed in detail below.

The crutch 1 also includes an adjustable handle 11 which is moveably, slidably attached to the upper crutch tube 3 so as to be grasped by the user to support themselves and operate the crutch 1 in a conventional manner well known to anyone who has had to use a crutch. The handle 11 can be slidably moved relative to the upper crutch tube 3 and the shoulder support 7 and is adjusted independently of the length of the crutch 1 so that varying arm lengths of different user's can be accommodated by the crutch 1. Also, as will be discussed in further detail below, the handle 11 can be provided with a manually operated valve control device to permit the user to actuate the gas spring 21 so as to lengthen or shorten the crutch 1. The shoulder support 7 for engaging underneath the arm and shoulder of the user as generally known is provided on the upper tube at the upper most end of the crutch 1. At the lower most end of the crutch 1, a rubber, plastic or similar non-slip material is applied as a ground engaging butt end 9 to ensure that the crutch 1 does not slip on any ground surface. It is to be appreciated that while a user usually utilizes two crutches, one with each arm for the appropriate balance and ease of movement, for purposes of brevity and clarity in this application only a single crutch and the operation thereof will be discussed.

Figure 4:
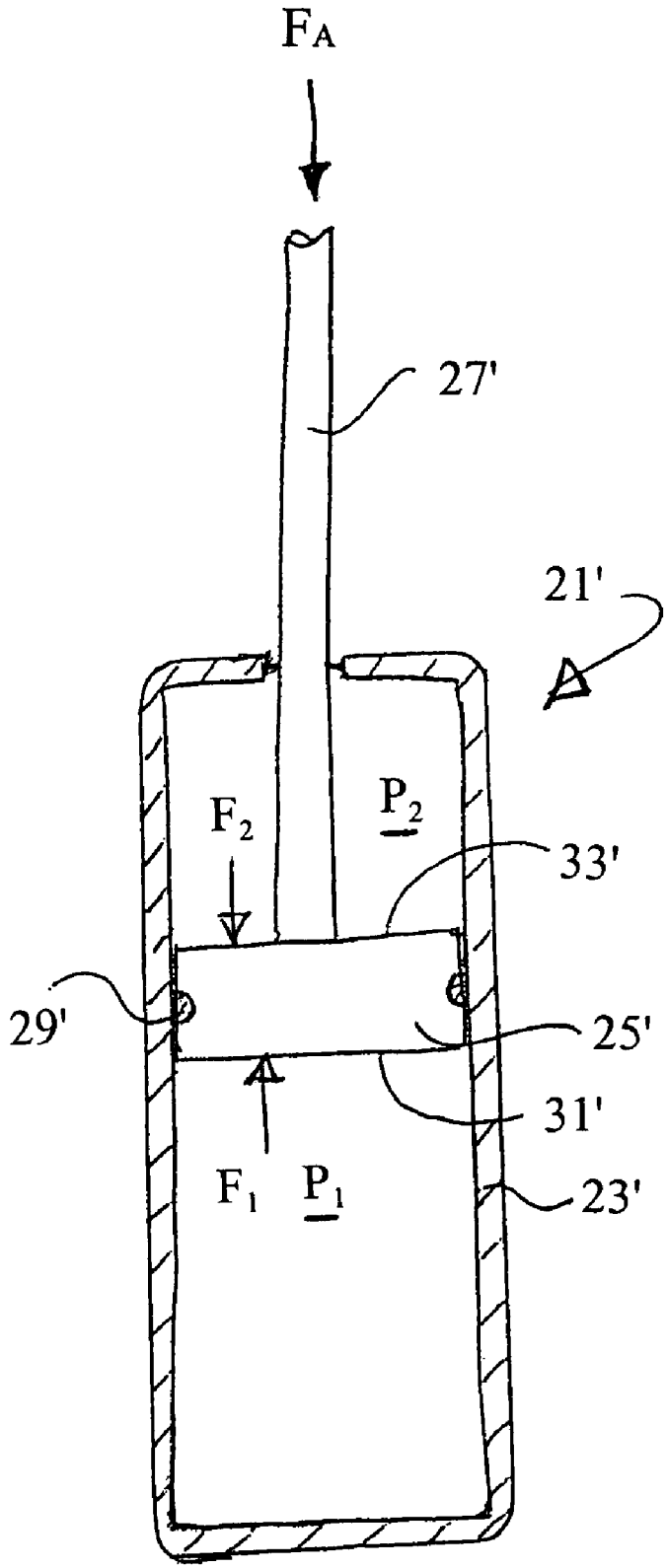
FIG. 4 is a cross-sectional front view of a gas spring of common construction.

In order to understand the operation of the above discussed crutch 1 in conjunction with the locking gas spring 41, the general construction and function of the gas spring 21 will now be discussed. As shown generally in FIG. 4 where like numbers of the gas spring represent the same elements in each disclosed embodiment, a gas spring 21' includes; a gas cylinder 23', a piston 25' contained within the cylinder 23', a piston rod 27' connected to the piston 25', and a seal 29' between the edge of the piston 25' and the cylinder wall. To understand how a gas spring works it is imperative to understand that in a steady state, i.e. before compressive forces are applied, the cylinder 23' is of course charged with some desired gas pressure P, and the gas pressures $P_1$ and $P_2$ on both sides of the piston 25' adjust themselves to a state according to the equation $F=P\times A$. Importantly, because the area of the face side 31' of the piston 25' is larger than the area of rod side 33' of the piston 25' due to the area taken up by the piston rod 27', the pressures $P_1$ and $P_2$ on either side will adjust so that $P_2$ is larger to accordingly cause equal forces $F_1$, $F_2$ acting on the face side 31', and the rod side 33' of the piston 25' respectively, essentially maintaining the piston 25' in an initial steady state position.

A force $F_A$ applied to the gas spring 21', for purposes of example through the piston rod 27', causes the piston 25' to move within the cylinder 23' reducing the volume on one side of the cylinder 23' thus causing a higher pressure $P_1$ on the respective side of the cylinder 23'. Because the face side 31' area remains the same, the increased pressure causes a corresponding increase in force $F_1$, thus acting to return the piston 25' to its initial steady state position once the applied force $F_A$ is removed. It is well known that as the volume of a gas cylinder 23' decreases, the mass of the gas remains constant, creating a higher pressure as is well known in the art.

Figure 5:
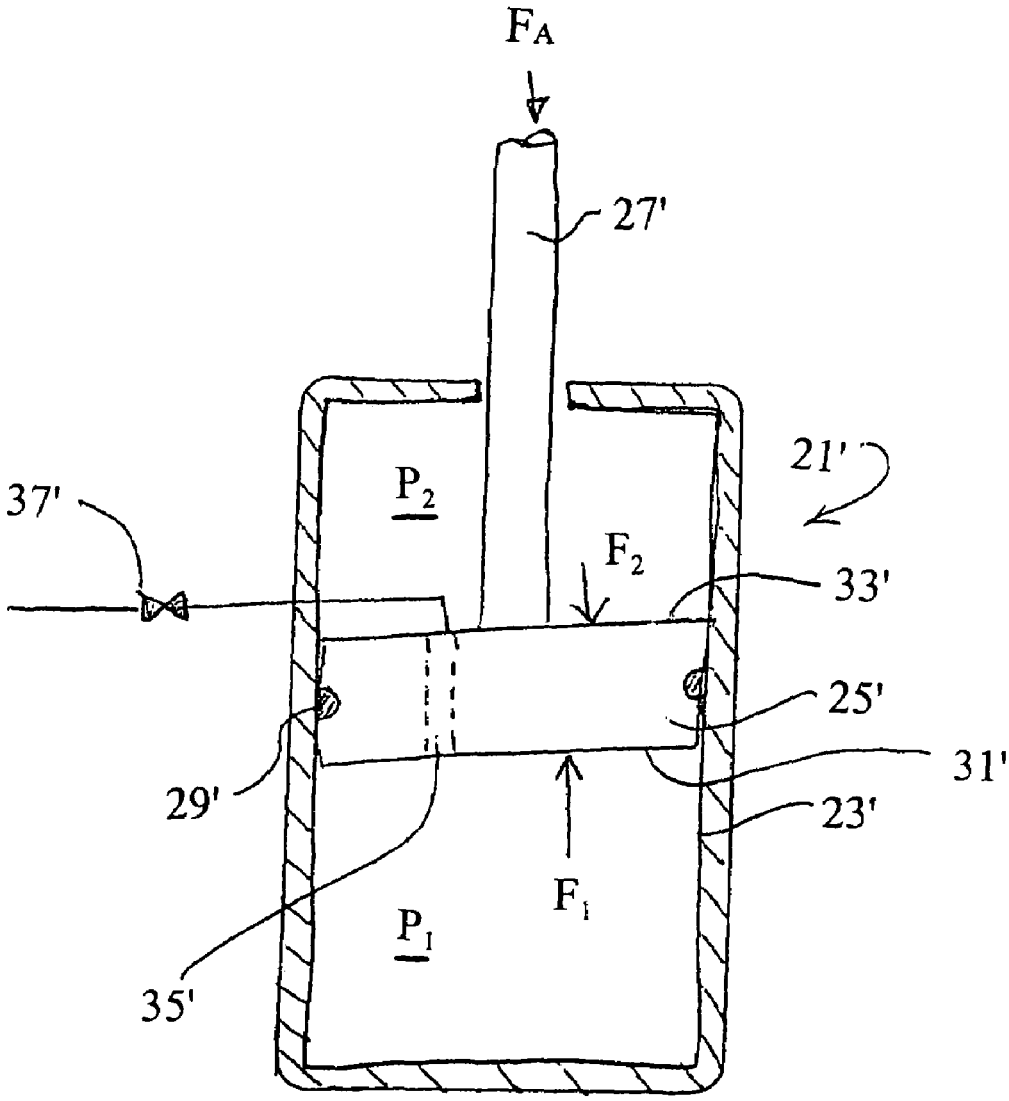
FIG. 5 is a cross-sectional front view of a locking gas spring of common construction.

Turning to FIG. 5, different from the simple gas spring described above, in a locking gas spring 21', a hole or valve 35' is located in the piston 25' to allow the pressure on both sides of the piston 25' to equalize as the piston 25' is compressed into the cylinder 23'. The valve through the piston 25' is controllable via a valve control device 37' to attain an open position allowing an equalization of the pressure on both sides of the piston 25' within the cylinder 23' as the piston 25' is compressed, and a closed position where such equalization is not permitted. Understanding basic gas theory as described above, where force is equal to a pressure multiplied over an area ($F=P\times A$), where there is a larger area defined by the face side 31' of the piston 25' and the pressures $P_1$ and $P_2$ are the same because of the open valve, a higher force $F_2$ will be generated to act on the face side 31' of the piston 25'. The magnitude of the higher force $F_2$ is dependant upon the pressure level inside the cylinder 23', the cross-sectional area of the cylinder 23' and piston 25', and the cross-sectional area of the piston rod 27'.

By way of further explanation, the locking gas piston is achieved by controlling the equalization of pressures on both sides of the piston 25', in other words controlling the amount of gas which is permitted through the valve 35' in the piston 25' as the system attempts to equalize the pressures on both sides of the valve. Thus, it is to be appreciated that at any point during operation of the locking gas spring 21' the valve 35' can be closed whether or not the pressures have equalized. This closing of the valve essentially "locks" the piston 25' in place in the cylinder 23' because the pressures $P_1$ and $P_2$ remain unequal while the forces on each side are equal. With the valve 35' closed, and the piston 25' locked in the desired position, again applying an external force $F_A$ to the piston rod 27', still with the valve closed, will not permit the piston 25' to move much, only as much as the compressibility of the gas will permit. Even where there is some slight movement of the piston 25', the increased pressure caused by the reduction in volume will return the piston 25' to the locked position.

On the other hand, with the valve 35' open, and the force $F_A$ applied to the piston rod 27' which in combination with force $F_2$ starts to equal or overcome the force $F_1$ pushing on the face of the piston 25', and the piston 25' now starts to slide down the cylinder 23' with gas pressure accordingly rising on the rod side 33' of the piston 25' as the mass of the gas the piston face side 31' of the piston 25' is allowed to pass through the open valve 35'. At some given point the valve 35' can again be closed, thus the differing pressures $P_1$ and $P_2$ and equal forces $F_1$, $F_2$ on each side of the piston 25' are now essentially "locked" into the respective sides of the piston 25' and cylinder 23'. The higher pressure on the rod side 33', along with the smaller area, now equals the lower pressure on the face side 31' of the piston 25' times the larger piston area, i.e. $F_1=F_2$ and the piston 25' is thus also locked in place.

If the valve 35' were merely to be opened at this point, with no force $F_A$ applied, the higher pressure $P_2$ on the rod side 33' would want to equalize and migrate through the valve 35' thus again permitting the face side force $F_1$ to become higher and return the gas spring 21' to an extended steady state position. The further structural and functional aspects of the locking gas spring 21 in combination with the crutch 1 are described in further detail below.

Figure 6:
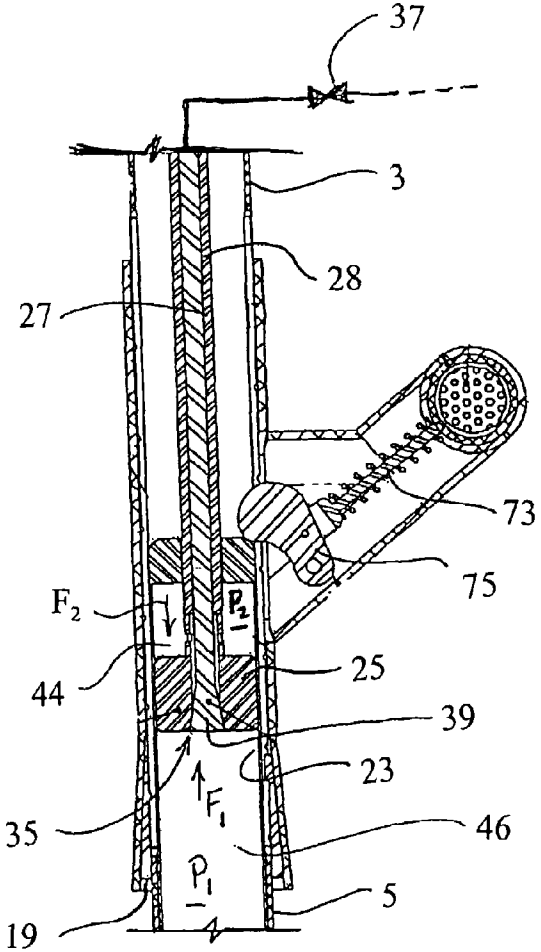
FIG. 6 is a cross-sectional side view of an embodiment of the handle portion of the crutch.

Turning to FIG. 6, the main body of the gas spring 21 i.e. the cylinder 23 containing the gas and the slidable piston 25, is located and essentially fixed within the lower crutch tube 5, and the free end of the piston rod 27 extends into and is directly attached to the upper crutch tube 3. Thus, as may be appreciated, movement of the piston 25 relative to the essentially fixed nature of the gas cylinder 23 in the lower crutch tube 5 which is essentially directly supported on the ground surface, causes the upper crutch tube 3 to be axially moved relative to the lower crutch tube 5 and the ground surface and thus to shorten and lengthen the crutch 1. A further description of the relative movement and operation of the gas piston 25 and crutch 1 is provided below.

The crutch length adjustment system works as follows. In an operative, i.e. a steady state position, wherein the crutch 1 is essentially fixed in length and the gas spring 21 is in a locked position, whether fully or partially extended, the forces F1, F2 acting on both sides of the piston 25 are equal as described above, because the pressure P2 in the upper portion of the gas cylinder 23 and the pressure P1 in the lower portion of the gas cylinder 23 are unequal, yet the areas over which the pressures act are inversely proportional relative to the pressure difference. Therefore, as long as the piston valve 26 is closed, the piston 25 will remain in the steady state locked position because the force differential as applied by the weight of the crutch 1 user is not great enough to compress the air or gas in the lower portion 46 of cylinder 23 i.e. overcome the pressure $P_1$ in the lower portion of the gas cylinder 23.

In order to raise or lower, i.e. extend or compress the crutch 1, the user must operate a pressure release assembly which opens the piston valve 26 via valve control device 37. To extend the crutch 1, the user removes their body weight, or a significant portion of their body weight, from the crutch 1 and operates the valve control device 37. Once the valve 35 is open, the pressures $P_1$, $P_2$ on both sides of the piston 25 begins to equalize, and the higher force $F_1$ acting upward overcomes the force $F_2$ acting downward and the piston 25 thus moves upward, i.e. extends the crutch 1 until a point at which the user releases the pressure relase assembly and closes the piston valve 26 or the piston 25 tops out at an upper end of the cylinder 23.

On the other hand, in order to compress the crutch 1, the larger force $F_1$ acting upward can be overcome by adding to the force $F_2$ generally by application of the crutch user's own body weight. It is to be appreciated that by specific design assuming equal pressures $P_1$, $P_2$ the upward force $F_1$ can be designed to be just larger than $F_2$ such that the piston 25, and thus the upper crutch tube 3, rise or extend in a controlled manner. Therefore in order to compress the crutch 1, i.e. lower the piston 25, the user can apply a portion of their body weight to the upper crutch via the shoulder support 7 and overcome the upward force $F_1$. In other words, the piston 25 can be lowered by a now greater force $F_{2+}F_A>F_1$, $F_A$ being the user's own body weight or a portion thereof acting downward on the piston 25 and/or upper crutch tube 3. Thus, the orientation of the gas spring 21 is optimized with the cylinder 23 essentially fixed to the lower crutch tube 5 and with the piston rod 27 extending upwards and fixed to the upper crutch tube 3.

It should be noted that the amount of force $F_2$ supplied by the crutch 1 and the force $F_A$ required to overcome the upward force $F_1$ can be controlled by the size of the piston valve 26 and the piston rod 27. The cross-sectional area of the piston rod 27 relative to the cross-sectional area of the piston 25 will determine the amount of net force $F_1$ acting upward on the piston 25. Furthermore, as the piston 25 is moving up or down in the shaft, air or gas is being forced through the valve of the piston 25 in an attempt to equalize the pressure. The diameter of the piston valve 26 determines how quickly and easily the air will move through the valve. A larger valve will allow more air to pass through the piston 25 quickly than a smaller valve.

The operation of the piston valve 35 and the valve control device 37 which opens and closes the piston valve 35 is now described. In one embodiment of the present invention the piston rod 27 includes a throughbore 28 which communicates with a passage through the piston 25. The passage through the piston 25 essentially defines the piston valve 35 which in turn provides communication between the upper cylinder chamber 44 and the lower cylinder chamber 46 as shown in FIG. 6 to permit the passage of gas or fluid therebetween. A valve stem 39 is inserted in the through bore of the piston 25 and extends into and substantially through the piston valve 26. The valve stem 39 is moveable relative to the piston 25 and piston rod 27 between an open position, permitting the passage of gas or similar fluid through the piston valve 26 and between the upper and lower cylinder chambers, and a closed position wherein the passage of gas or fluid through valve 35 between the upper and lower cylinder chambers is blocked. It is also to be appreciated that other known structures of valves and locking gas pistons could be utilized as well.

Figures 7, 7A:
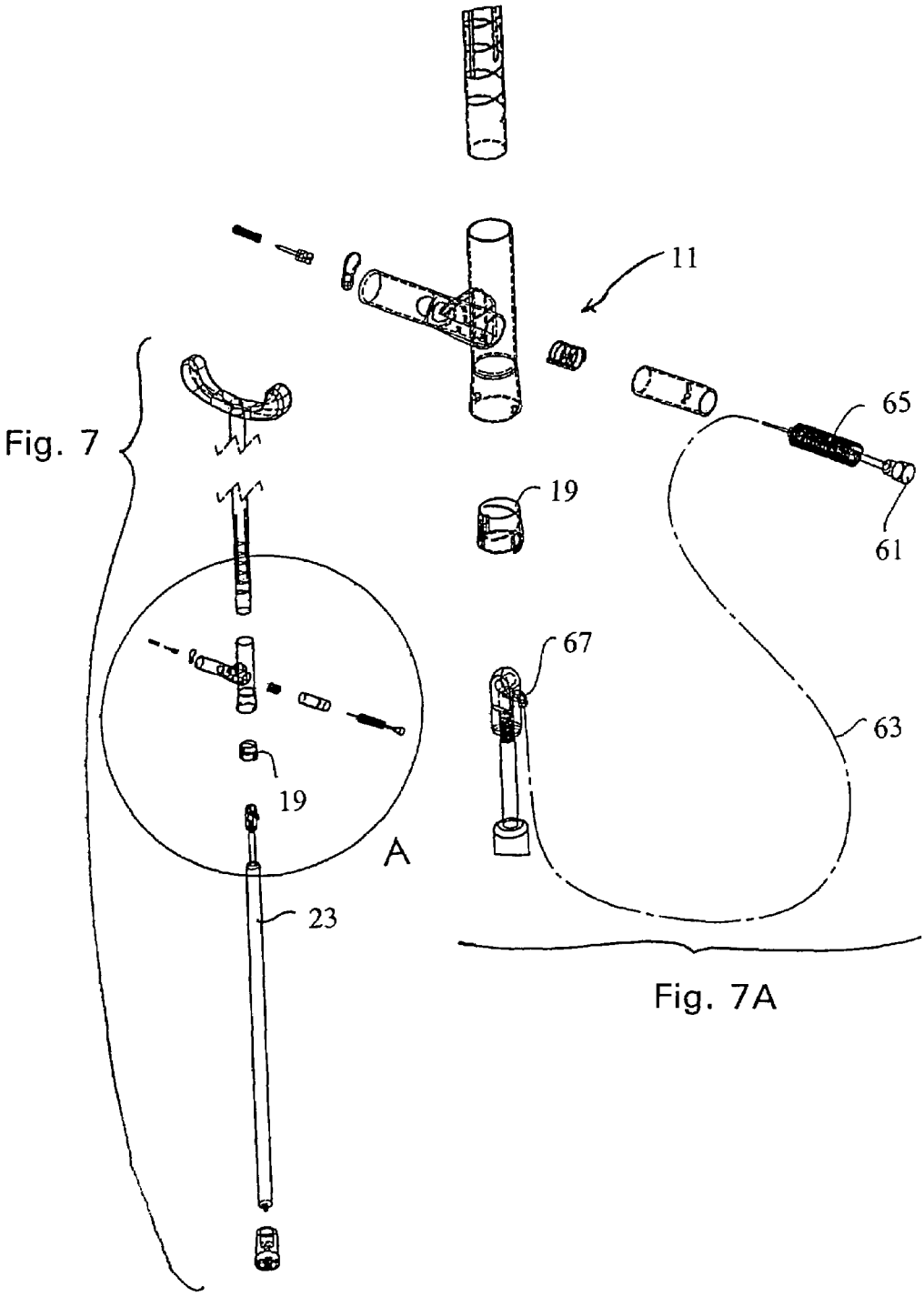
FIGS. 7 and 7A are an exploded view of the crutch, handle, locking gas piston and valve actuating mechanism.

The opening and closing of the piston valve 26 is controlled by the valve stem 39 which is in turn controlled by the valve actuator 37 actuated by the crutch user. A manually operated button or lever 61 may be located on the handle 11 of the crutch 1 to facilitate the actuation of the valve. Communication between the valve stem 37 and the button 61 to open and close the piston valve 26 can be done through a hydraulic valve stem operation mechanism 63 as seen in FIG. 7. The hydraulic valve stem operation mechanism 63 can include a first hydraulic cylinder piston 65 associated with the button 61 or lever located on the handle 11 of the crutch 1. The first hydraulic cylinder piston 65 is connected via a link, for example a hydraulic line, to a second cylinder piston 67 that cooperatively operates the valve stem 37 to move into the open and closed positions relative to the hollow piston rod 27 and the piston 25. For example actuation of the button 61 or lever on the crutch handle 11 would open the valve 35 via the hydraulic valve stem operation mechanism 63 to permit relative extension or compression of the upper and lower crutch tubes 3, 5.

Thus, assuming that the crutch 1 is in an initial steady state at a length which accommodates a particular user traveling or walking with the crutch 1 along the ground, when the crutch user finds it necessary to sit down, the user will maintain, or apply a sufficient portion of their body weight to the upper crutch tube 3 via the handle 13 or the shoulder support 7 and simultaneously actuate button 61 of the piston valve actuator 63 located in the clutch handle 11. Actuation thus opens the piston valve 35 via the first and second cylinder pistons 65, 67 of the hydraulic valve stem operation mechanism 63, biasing the piston valve 35 into the open position. The user's weight $F_A$, added to the force $F_2$ thus overcomes force $F_1$ acting upward and causes the piston 25 to travel downwards through the cylinder 23 with the upper crutch tube 3 correspondingly traveling downwards over the lower crutch tube 5 until either the user closes the piston valve 26, or the piston 25 bottoms out in the cylinder 23. Now the crutch user has been lowered closer to the ground and thus closer to for example a sitting position which they desire to attain.

In order to return the crutch 1 to the extended travel or walking position the user need only operate the release assembly without their body weight, i.e. force $F_A$, or a significantly reduced body weight portion, applied to the upper crutch tube 3 whereby the valve is opened again and the pressures $P_1$ and $P_2$ begin to equalize and the correspondingly larger force $F_1$ pushes the piston rod 27 back to what is generally a user defined crutch height corresponding to the user's comfort and physical size.

The crutch adjustment system is required to accommodate as many human body types as possible. The system is design to adjust easily to essentially two common physical proportions. First, the user's height determines a user defined maximum height ie. a maximum extension for the crutch 1. Secondly the handle 11 may be adjusted to accommodate the user's arm length. For example, a person six-foot-one-inch tall of typical proportions will have an arm-length in a range which is of course generally different than a person who may be five-foot-one-inch tall. A change in height can therefore be expected to have a change in arm length. Importantly, this individual or personal user adjustment of the handle height is essentially an independent function from that previously described regarding the relative adjustability of the upper and lower crutch tubes for the reason that the handle 11 does not move relative to the upper crutch tube 3 to which it is connected when the upper and lower crutch tubes are extended or compressed. Although the handle is adjustable, once set for a specific user, the handle 11 of the crutch 1 should remain fixed relative to the upper crutch tube 3 and the shoulder support 7.

However the two adjustments are not entirely independent functions as the user defined maximum height of the crutch 1 which is of course defined individually by each user acts in a manner to automatically restrain the extension of the piston rod 27 in conjunction with the piston valve actuator 61 and the handle 11.

Figure 8:
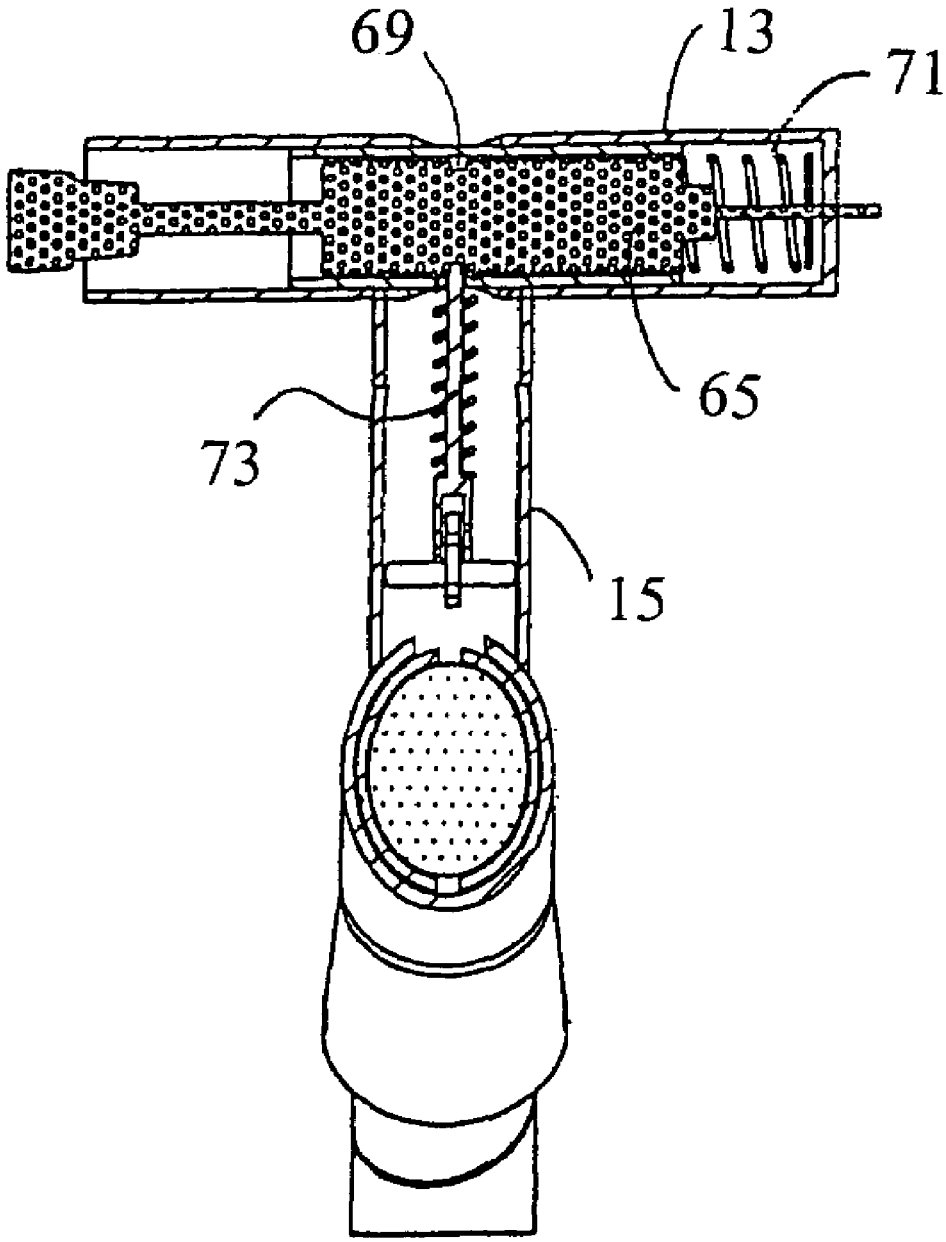
FIG. 8 is a further cross sectional view of an embodiment of the handle portion of the crutch.

In FIGS. 6, 7 and 8, the intersection of the upper crutch tube 3, lower crutch tube 5, and handle assembly are shown in different views. The handle assembly is comprised of a hollow cylinder body 13 for slidably engaging the upper crutch tube 3, a protruding handle support 15 and a handle 11. Also, a wedge 19 which is threaded and dogged is designed to be inserted into a lower slightly flared lower portion of the cylinder body. Inside the handle 11, is a portion of the hydraulic valve stem operation mechanism 63, more specifically the first hydraulic cylinder piston 65 associated with the button or lever located on the handle 11 of the crutch 1. Best seen in FIGS. 6 and 8, the first hydraulic cylinder piston 65 is filled with hydraulic fluid and the button 61 compresses the hydraulic fluid to actuate the hydraulic valve stem operation mechanism 63. The cylinder piston 65 is generally fixed in the handle 13 by a locking pin 73 engaging a radial groove 69 or detent in the wall of the cylinder piston 65. The hydraulic button 61, cylinder piston 65, locking pin 73 and a cylinder position follower 75 in the handle assembly play an essential role as a safety mechanism for automatically disengaging the hydraulic valve stem operation mechanism 63 to stop the crutch extension when the crutch 1 reaches a user-defined maximum height.

The first hydraulic cylinder piston 65 located in the handle body has the radial groove 69 which receives one end of the locking pin 73 as seen in FIG. 8. The hydraulic button assembly also has the manually operated external button 61 and a button return spring 71, both of which will be discussed in greater detail later. Observing FIGS. 6-11, the locking pin 73 is also attached to the cam-like cylinder position follower 75 which is rotatably fixed to the inside of the handle 11. Although the cam follower 75 is shown in FIG. 6 having passed or fallen, over the top of the gas cylinder, under normal operation the cam follower is in contact with the side of the gas spring cylinder 23. In this condition with the cam follower 75 in contact with the side of the gas spring cylinder 23 the locking pin 73 is pushed outwards to intersect the button body groove 69, thus preventing the button assembly from moving along its centerline, regardless of force applied by a user pressing the button 61.

During the course of operation, the cam-like cylinder piston follower 75, which is attached via a pin to the inside of the handle body, will be in contact with the outer wall of the gas spring cylinder 23. As the crutch 1 is extended and the piston 25 is forced upward, thus also moving the upper crutch tube 3 upward relative to the lower crutch tube 5, the handle 11 and the associated cam-like cylinder piston 25 rides upwards along the side of the gas cylinder 23. Once the cam-like cylinder piston 25 reaches the top of the gas cylinder 23, the follower will fall over the top of the gas cylinder 23, withdrawing the locking pin from the hydraulic cylinder piston 65 and activating the automatic disengagement system as shown in FIG. 6.

As the cylinder position follower 75 rotates over the top of the gas cylinder 23, the locking pin 73 is pulled out of the radial groove 69 in the first hydraulic cylinder piston 65. As a result, the first hydraulic cylinder piston 65, which has an internal hydraulic spring constant greater than the button return spring 77 constant, is pushed into the hollow handle 11 by the force applied by the user to the external button 61. As the hydraulic button 61 and the hydraulic cylinder piston 65 are pushed into the handle body, the pressure inside the first hydraulic cylinder piston 65 is released and the piston valve 35 is closed. This prevents any further movement of the piston 25 and thus prevents any further undesired extension of the crutch 1.

Should the user want to extend the crutch 1 past its preset maximum height, the user may override the automatic disengagement system by sticking a finger deeper inside the handle body and pressing the external button 61 until the button return spring 77 is fully compressed and the first hydraulic cylinder piston 65 resumes transmitting hydraulic fluid pressure and opening the piston valve 35. This allows the user to only consciously extend the crutch 1 to a height higher than that imposed by the preset user defined maximum height.

Figure 9A:
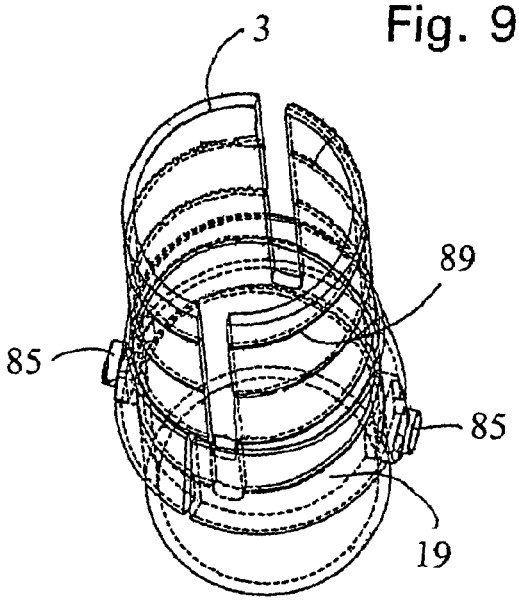
FIGS. 9A and 9B are perspective views of the wedge in combination with a portion of the upper crutch tube and the wedge alone.
Figure 9B:
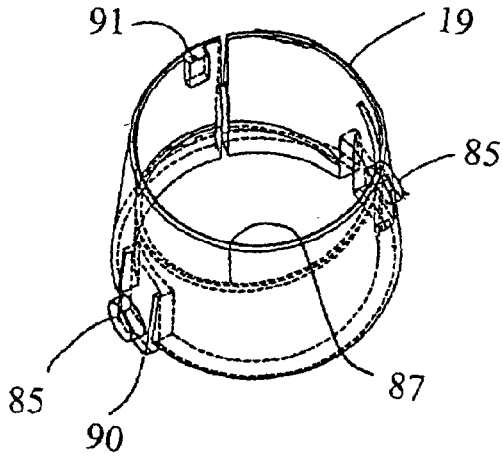
Figure 10:
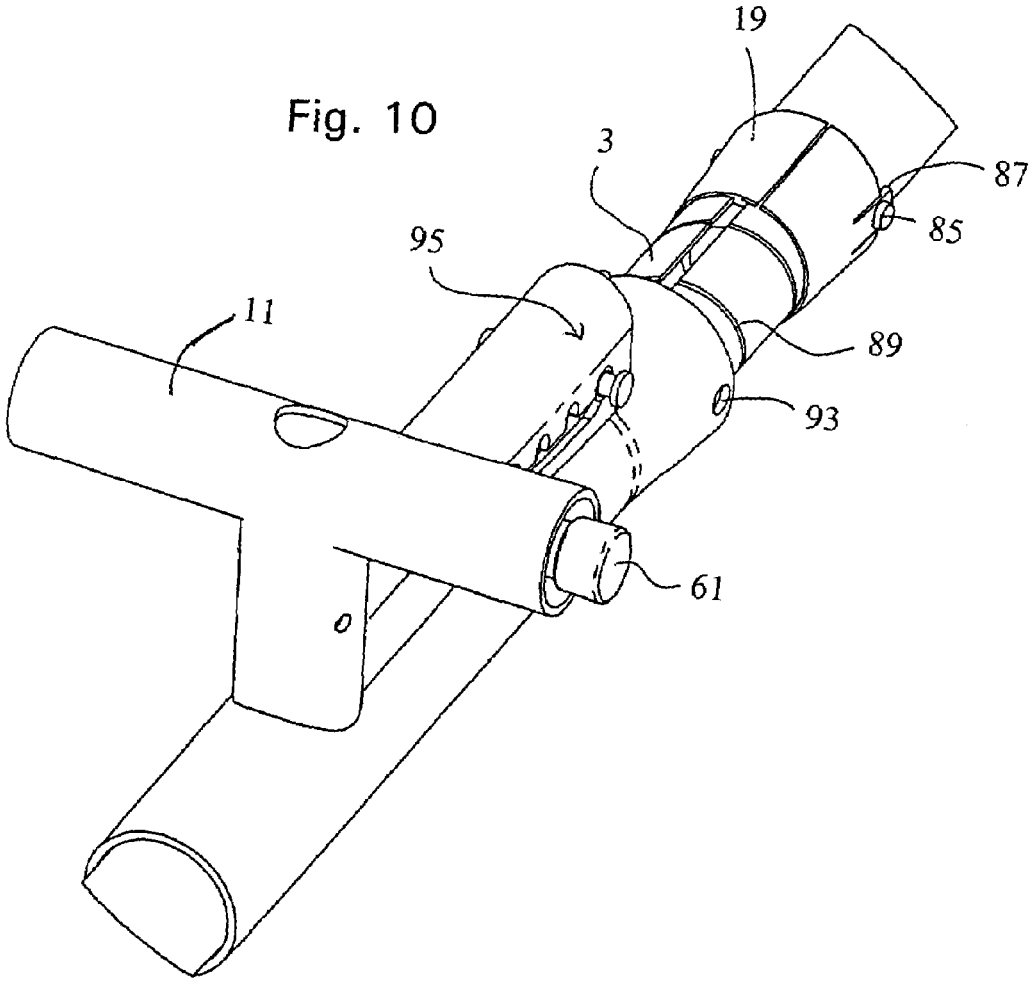
FIG. 10 is a perspective view of the wedge in use on the upper crutch shaft in cooperation with the handle.

The handle vertical position adjustment and alignment feature relative to the upper crutch tube 3 is controlled by the manipulation of the wedge component of the handle system, shown in FIGS. 9A, 9B and 10. The wedge 19 has two flexible tabs 90 with an outwardly protruding boss 85 on each arm. Once the wedge 19 is aligned in the appropriate position on the upper crutch tube 3 to accommodate the user's arm length, these bosses insert into the handle body to maintain the handle 11 in the specific alignment with the wedge 19 when this adjustment is completed.

To adjust the wedge 19 into the appropriate position, the wedge 19 is provided with an inner wedge thread 87 that engages a corresponding upper crutch tube thread 89. This permits the user to threadably adjust the wedge 19 along the length of the upper crutch tube 3 to the extent of the crutch 1 tube thread thereon. Additionally, the wedge 19 is provided with a dog 91 that engages at least a vertical slot in the upper crutch tube 3. The wedge 19 is also segmented by a cut portion to allow the dog 91 to be disengaged out of the vertical slot while the thread features on the remainder of the wedge 19 remain engaged. The dog 91 can re-engage into the vertical slots in the upper crutch tube 3 every 180 degrees of rotation, or wherever the slots are provided around the circumference of the crutch tube, providing for the wedge 19 to be thus rotatably locked from rotation while the engaged threads maintain the vertical alignment of the wedge 19 and the upper crutch tube 3.

Once the wedge 19 has been manipulated into a desired position and the dogs and threads maintaining the wedge 19 in a desired position, the handle 11 may then be forced down over the wedge 19 until the wedge bosses align and engage respective receiving holes 93 in the handle 11. This assembly provides for up/down position and proper orientation of the handle assembly, it also provides positive means against slipping up or down. The wedge shape is used to greatly reduce the loads that would be seen at the thread and wedge bosses if the wedge shape was not used. This reduction in loads at the thread and bosses allows for the wedge 19 to be manufactured out of a lightweight and flexible material such as plastic.

Figure 11:
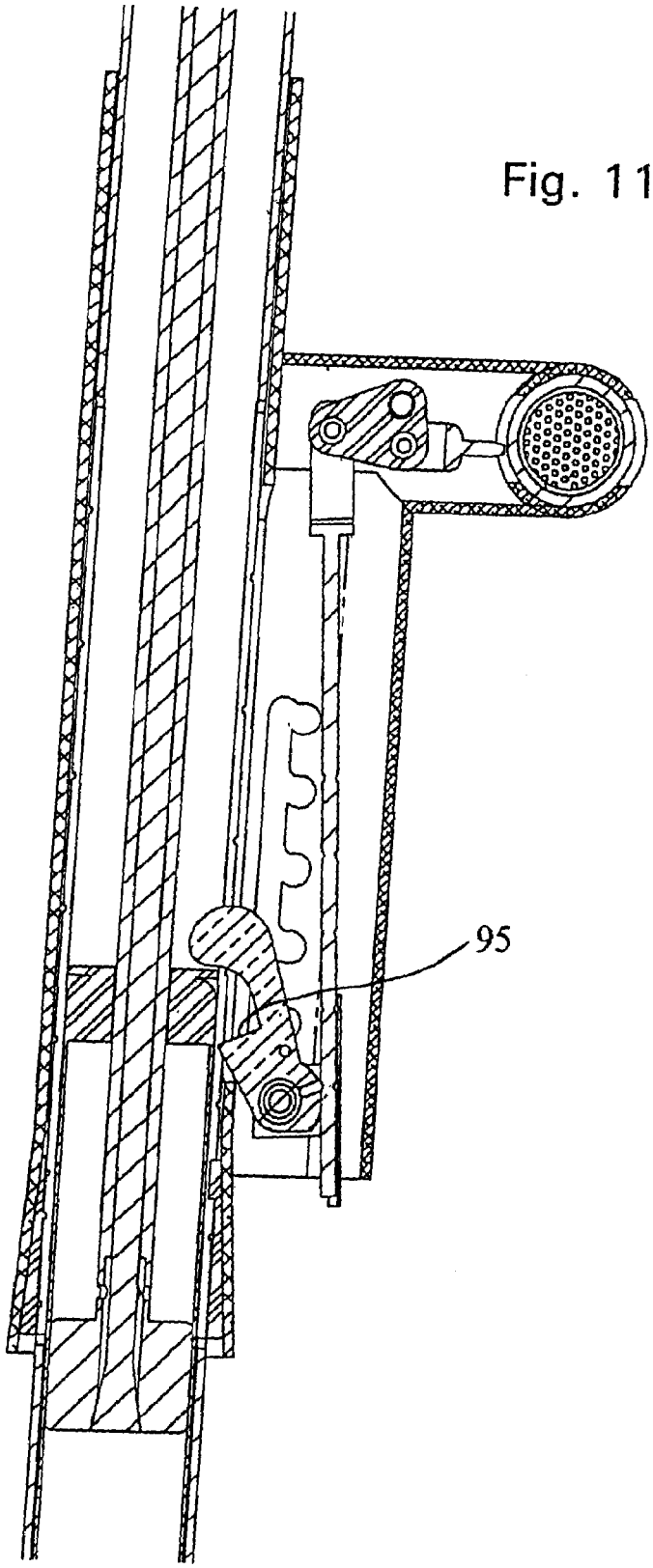
FIG. 11 is a cross-sectional view of a further embodiment of the handle and piston extension stop mechanism.

Another embodiment of the invention shown in FIGS. 10, 11 may have an additional pawl 95 to back up the cylinder follower system. This will allow for a preset normal height by halting the cylinder 23 if the button is not released before the maximum set height is attained. If additional height is required, the user can override the position by depressing the release button deep 61 into the handle 11 and adjusting the handle 11 accordingly.

In one embodiment, the gas spring 21 has approximately a 20-30 inch, and more preferably about a 24 inch travel stroke. There is provided between about 60-100 lbs and preferably about 80 lbs pre-load and between about 90-130 lbs, preferably about 110 lb. full compression force requirement. On return, at full compression, about 100 lbs. are delivered, and about 70 lb. at full extension. The body diameter is approximately 22 mm, and the telescoping shaft diameter is about 10 mm. The overall length of the crutch 1 is approximately 52 inches. In general a gas spring of this or similar construction can accommodate a user with the approximately 24 inch travel stroke where the user is in a range of between about 6 foot 2 inch, and 5 feet 5 inches. It is to be appreciated that other lengths of crutches would permit persons of any size to utilize the full stroke as well.

Since certain changes may be made in the above described improved, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. An adjustable crutch for facilitating mobility, comprising:

a telescoping shaft having an upper and lower crutch tube aligned on a concentric axis;

a handle attached to an intermediate portion of the telescoping shaft, a shoulder support attached to the crutch on a first end of the upper crutch tube and a ground engaging butt end positioned at a first end of the lower crutch tube;

a locking gas spring comprising a gas cylinder and a moveable piston is positioned inside the telescoping shaft for controlling relative slidable movement between the upper and lower crutch tubes of the telescoping shaft;

a control button is positioned on the handle for operating the gas spring, and an automatic disengagement mechanism is connected to the control button for automatically disengaging the control button from operation of the gas spring at a variable preset extension limit of the gas spring; and wherein the handle comprises a hollow cylinder body, a protruding handle support, and a handle piece and the hollow cylinder body of the handle slidably engages the upper crutch tube of the telescoping shaft and is adjustably supported thereon via a handle lock dog which threadably engages the upper crutch tube.

2. The adjustable crutch as set forth in claim 1 wherein the gas cylinder is fixed within the lower crutch tube and the piston is fixed to the upper crutch tube so that where the first end of the lower crutch tube is supported on a ground surface, relative slidable movement between the upper and lower crutch tubes is accomplished by moving the piston and the upper crutch tube relative to the gas cylinder and the lower crutch tube respectively.

3. The adjustable crutch as set forth in claim 2 further comprising a static operation mode wherein a valve in the locking gas spring is closed and permits substantially no relative slidable movement between the upper and lower crutch tubes and a dynamic mode wherein a valve in the locking gas spring is opened and relative slidable movement between the upper and lower crutch tubes is permitted.

4. The adjustable crutch as set forth in claim 3 wherein the automatic disengagement mechanism permits relative slidable extension between the upper and lower crutch tubes in the dynamic mode up to a preset variable extension limit.

5. The adjustable crutch as set forth in claim 4 wherein the handle of the adjustable crutch is adjustably supported directly on the uppermost crutch tube relative to the shoulder support to provide a variable distance between the handle and the shoulder support to account for varying arm lengths of different users.

6. An adjustable crutch for facilitating mobility, comprising:

a telescoping shaft having an upper and lower crutch tube aligned on a concentric axis;

a handle attached to an intermediate portion of the telescoping shaft, a shoulder support attached to the crutch on a first end of the upper crutch tube and a ground engaging butt end positioned at a first end of the lower crutch tube;

a locking gas spring comprising a gas cylinder and a moveable piston is positioned inside the telescoping shaft for controlling relative slidable movement between the upper and lower crutch tubes of the telescoping shaft;

a control button is positioned on the handle for operating the gas spring, and an automatic disengagement mechanism is connected to the control button for automatically disengaging the control button from operation of the gas spring at a preset extension limit of the gas spring; and wherein adjustment of the handle causes the automatic disengagement mechanism to effect the preset extension limit of the gas spring.

7. The adjustable crutch as set forth in claim 6 further comprising a link between the button in the handle and the valve in the gas spring for at least one of opening and closing the valve.

8. The adjustable crutch as set forth in claim 7 wherein the automatic disengagement mechanism disengages the link between the button in the handle and the valve in the gas spring so that operation of the gas spring is ceased.

9. The adjustable crutch as set forth in claim 8 wherein the disengagement mechanism comprises a gas cylinder follower having a first position wherein the gas cylinder follower completes link between the button in the handle and bypass valve in the piston, and a second position wherein the gas cylinder follower breaks the link between the button in the handle and bypass valve in the piston so as to interrupt operation of the gas spring.

10. The adjustable crutch as set forth in claim 9 wherein in the first position of the gas cylinder follower the link permits actuation of the button to open the bypass valve in the piston and release of the button to close the bypass valve in the piston, and in the second position the link is interrupted so that the button cannot operate the link and the valve is maintained in a closed position.

11. The adjustable crutch as set forth in claim 10 wherein the button is provided with an override position to restore the link between the bypass valve and the button.

12. A crutch adjustment system for aiding persons with mobile difficulties comprising:

a crutch having a locking gas spring having a cylinder, a piston, a piston valve, and a piston rod;

a manually actuated hydraulic button assembly for controlling the piston valve;

a cylinder position follower for detecting the position of the gas spring cylinder;

a locking rod, attached to the cylinder position follower, interlocking with the hydraulic button assembly;

the locking rod disengages the manually actuated hydraulic button assembly as the cylinder position follower follows the gas spring cylinder beyond a pre-set location; and wherein the pre-set location of the gas spring is defined according to an adjustable positioning of the handle relative to the shoulder support.

13. The crutch adjustment system as set forth in claim 12 wherein the cylinder position follower permits slidable extension of the piston up to the pre-set location and then interrupts a link between the hydraulic button assembly and the piston valve in the gas spring so that the piston valve is automatically closed.

14. The crutch adjustment system as set forth in claim 13 whereby the locking gas spring is capable of providing between 60-100 lbs pre-load force and between about 90-130 lbs compression force and the piston valve has between about a 20-30 inch stroke.

* * * * *